United States Patent [19]

Jansson et al.

[11] Patent Number: 4,760,887

[45] Date of Patent: Aug. 2, 1988

[54] DRILL ELEMENT FOR PERCUSSION DRILLING

[75] Inventors: Kjell-Ove L. Jansson; Lars E. Liljeblad, both of Sandviken; Bernt S. Liljekvist, Storvik, all of Sweden

[73] Assignee: Santrade Limited, Lucerne, Switzerland

[21] Appl. No.: 831,634

[22] Filed: Feb. 21, 1986

Related U.S. Application Data

[63] Continuation-in-part of Ser. No. 816,327, Jan. 6, 1986, abandoned.

[30] Foreign Application Priority Data

Jan. 7, 1985 [SE] Sweden ..... 8500049

[51] Int. Cl.[4] ..... F16B 7/18; E21B 17/02

[52] U.S. Cl. ..... 173/132; 403/307; 403/343

[58] Field of Search ..... 173/104, 132; 279/7, 279/99; 285/390, 355; 403/307, 343, 118; 175/415, 325; 408/226

[56] References Cited

U.S. PATENT DOCUMENTS

| | | | |
|---|---|---|---|
| 3,645,570 | 2/1972 | Johansson et al. | 403/307 |
| 3,717,368 | 2/1973 | Czarnecki et al. | 403/343 |
| 4,295,751 | 10/1981 | Holmberg | 403/307 |
| 4,332,502 | 6/1982 | Wormald et al. | 403/343 |

*Primary Examiner*—E. R. Kazenske
*Assistant Examiner*—James L. Wolfe
*Attorney, Agent, or Firm*—Burns, Doane, Swecker & Mathis

[57] ABSTRACT

The invention relates to a drill element for percussion drilling, the element having a cylindrical screw thread having one single entry. The screw thread, that is intended for thread diameters of less than 30 mm, has a pitch of less than 12 mm, a shoulder angle of less than 69°, and a pitch angle of less than 11° but more than 5.6°.

16 Claims, 2 Drawing Sheets

DRILL ELEMENT FOR PERCUSSION DRILLING

RELATED INVENTIONS

This is a continuation-in-part of U.S. application Ser. No. 06/816,327 filed Jan. 6, 1986, now abandoned by the present inventors and now abandoned.

BACKGROUND AND OBJECTS OF THE INVENTION

The present invention relates to a drill element for percussion drilling, e.g., a drill rod, a coupling sleeve or a drill bit, said drill element having a female or a male cylindrical screw thread having an external diameter less than 30 mm, preferably less than 25 mm, and having one single entry. The drill element is intended to be coupled up to another element included in a percussion drill string.

The invention primarily refers to drill elements having threads of the type called round or rope threads. These threads have a constant radius of curvature at both the top and the bottom of the thread. Portions of the thread have a thread surface almost parallel to the longitudinal axis of the drill element. In order to prevent those surfaces from being wedged-up, the radius of curvature at the top of the male thread and the bottom of the female thread is made somewhat larger than the radius of curvature at the bottom of the male thread and the top of the female thread, respectively. However, the invention is generally applicable on drill elements having cylindrical screw threads having one single entry.

The rope threads according to the prior art have turned out to perform well in connection with relatively large thread diameters when used together with rock drills having low to medium high drilling power. The thread profile in such cases is kept unchanged independent of the thread diameter. However, it has turned out that for smaller thread diameters, primarily the standard diameters of 22 mm and 25 mm, the life span and the unscrewing characteristics are not satisfactory. These negative characteristics become even more acute if the drilling equipment is used at a low working pressure, i.e., a working pressure less than the normal one of 7 bar. The main reason for the rapid wearing out of the thread semms to be that the thread is too easy to unscrew and thus is shaken loose at regular intervals during drilling. This causes the creation of so-called pittings on the shoulders.

The object of the present invention is to provide a drill element that for smaller thread diameters has a longer life span and improved unscrewing characteristics compared to rope threads of standard type.

Another object of the invention is to provide a drill element that has a long life span and good unscrewing characteristics also at a low working pressure

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DESCRIPTION OF A PREFERRED EMBODIMENT OF THE INVENTION

The rope threads of standard type have the same thread profile for diameters within the interval 22 mm to 51 mm. The pitch of the thread profile is 12.7 mm, its thread depth is 1.6 mm, its pitch angle is about 11.3°, its thread shoulder angle is about 69°, and its radii of curvature at the top and bottom of the thread are 6.0 mm and 5.5 mm, respectively. As mentioned above, this thread profile has turned out to have an unsatisfactory length of life and unscrewing characteristics at smaller threads diameters, especially if the working pressure is low. For the torque of unscrewing threads, the following formula is valid:

$$M = F \cdot d_m/2 \frac{\mu - \cos\beta \tan\alpha}{\cos\beta + \mu \tan\alpha} + F \cdot \mu \cdot r_m, \quad (1)$$

Figure 4:
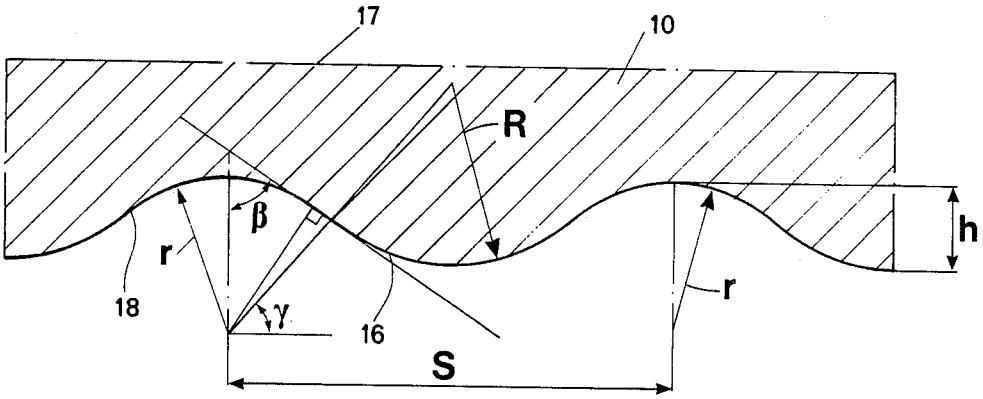
FIG. 4 shows in enlarged scale one of the elements of FIG. 3.

M=the torque of unscrewing,
F=the force applied,
$d_m$=the effective diameter or the average diameter,
$\beta$=the shoulder angle as defined in FIG. 4,
$\alpha$=the pitch angle,
$/\mu$=the friction coefficient, and
$r_m$=the average radius for the end surface.

The shoulder angle $\beta$ is calculated from the following formulas:

$$\cos(\beta - \alpha) = \frac{r + R}{\sqrt{(s)^2 + (R + r - h)^2}} \quad (2)$$

$$\tan\alpha = \frac{r + R - h}{s/2}, \quad (3)$$

r=the radius of curvature at the bottom of the thread,
R=the radius of curvature at the top of the thread,
s=the pitch, and
h=the profile height or the depth of the thread.

The average diameter $D_m$ is calculated from the formula:

$$D_m = D_y - h \pm (R - r)\left(2 \frac{1}{\cos(90 - \beta)} - 1\right), \quad (4)$$

Dy=the outside diameter of the thread, the plus sign relates to a male thread and the minus sign relates to a female thread.

The pitch angle $\alpha$ is calculated from the formula $$\tan\alpha = \frac{s}{D_m \cdot \pi}. \quad (5)$$

From the formula (1) you can see that the torque of unscrewing threads is a function of the pitch angle $\alpha$ and the shoulder angle $\beta$. It can be stated that the smaller the pitch angle $\alpha$ and the shoulder angle $\beta$ are the harder it is to unscrew the thread. Consequently, the shoulder angle $\beta$ should be maintained and certainly not increased if the pitch angle $\alpha$ is decreased to achieve a more tight thread connection.

Figure 1:
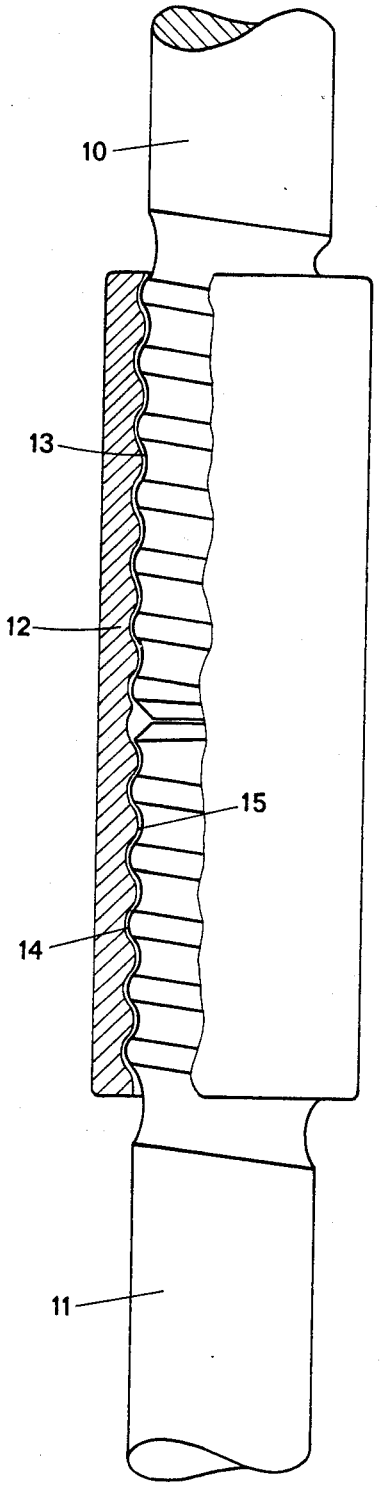
FIG. 1 depicts a coupling in a percussion drill string, said coupling comprising two rod ends and a coupling sleeve, said elements having threads according to the invention.
Figure 2:
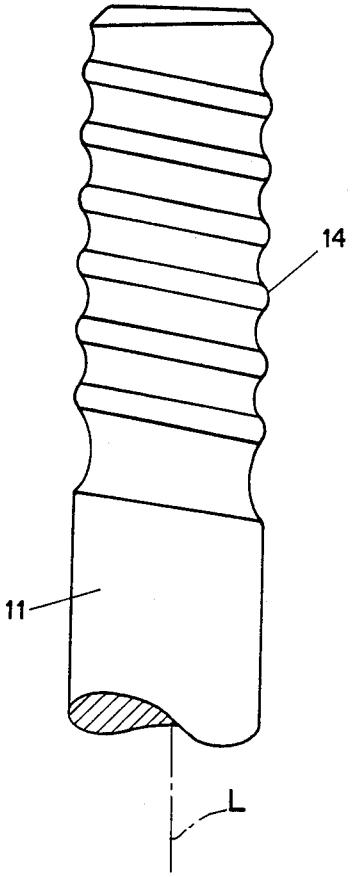
FIG. 2 depicts an end of a rod having a thread according to the invention.
Figure 3:
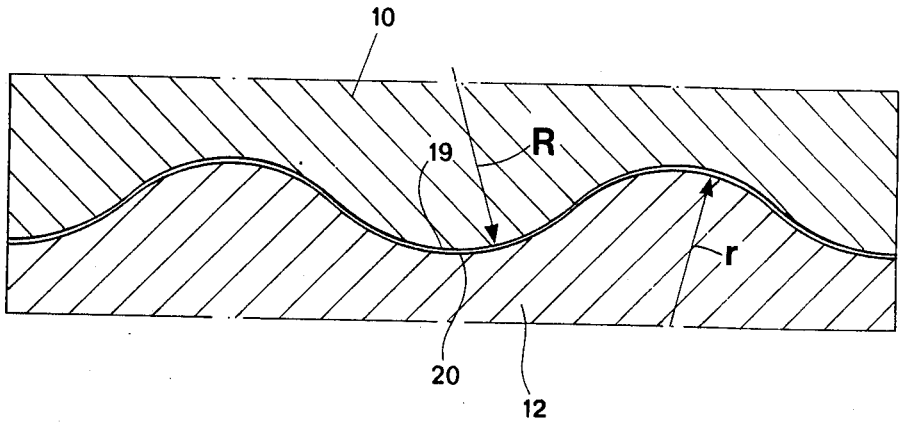
FIG. 3 shows is in enlarged scale a part of the coupling of FIG. 1.

In the coupling disclosed in FIG. 1, two percussion drill rods 10, 11 are joined by a coupling sleeve 12. The drill rods 10, 11 contain a male cylindrical screw thread 15.

As can be seen from FIG. 4 the shoulder angle $\beta$ is defined as the inclination of the thread shoulder relative to a plane perpendicular to the longitudinal axis 17 of the drill element From FIG. 4 can also be seen how the pitch s and the profile height or depth of the thread is defined.

According to the invention, it has surprisingly turned out that if the pitch angle $\alpha$ of standardized rope threads is decreased, i.e., $\alpha<11°$, and the shoulder angle $\beta$ of standardized rope threads simultaneously is decreased, i.e., $\beta<69°$, a thread connection of smaller diameters is achieved that has a very long life span and good unscrewing characteristics, both at a normal working pressure, i.e., about 7 bar, and at a low working pressure, less than 7 bar. According to the invention, the pitch angle $\alpha$ is more than 5.6° and the pitch s of the thread is less than 12 mm. In this case smaller diameters are those that have an outside diameter of less than 30 mm, primarily the standard diameters of 22 mm and 25 mm. The thread according to the invention has one single entry.

In a preferred embodiment the pitch angle $\gamma$ is within the interval 5.6° to 7.6°, the pitch s is less than 9 mm, the radius of curvature R at the top of the screw thread is less than 6 mm, preferably less than 4 mm, and the profile height h is less than 1.6 mm, preferably less than 1.5 mm. The relation between the radius of curvature R and the profiles height h is less than 3.75, preferably less than 2.6.

In the disclosed embodiment the pitch angle $\gamma$ is about 6.6°, the pitch s=7.5 mm, the radius of curvature R=3.0 mm, the shoulder angle about 60°, and the profile height h=1.35 mm. This results in that the relation R:d is about 2.2. The radius of curvaturer at the bottom of the screw thread is 2.5 mm, and the two radii of curvature R and r have a constant value.

In the disclosed embodiment, the screw thread mainly has convex or concave shape, i.e., the radii of curvature r, R have constant values. However, the thread profile can be varied within the scope of the claims, i.e., it should be guaranteed that those of the thread shoulders 16 where contact takes place are designed in accordance with the invention. The opposite thread shoulder 18 as well as the intermediate portions 19, 20 can, however, be modified in order to achieve a thread profile having a radius of curvature that varies. In the disclosed embodiment the invention is related to a coupling between two drill rods. However, the invention is applicable to all elements of a percussion drill string, e.g., drill bits.

Although the present invention has been described in connection with a preferred embodiment thereof, it will be appreciated by those skilled in the art that additions, substitutions, modifications and deletions not specifically described may be made without departing from the spirit and scope of the invention as defined in the appended claims.

What we claim is:

1. Drill element for percussion drilling, said drill element defining a longitudinal axis and having a rope thread with an external diameter less than 30 mm, and one single entry, said drill element adapted to be coupled to another element included in a percussion drill string, said rope thread including a crown and a root which are radiused as viewed in longitudinal cross-section, said crown having a constant radius of curvature less than 6 mm, and said root having a constant radius of curvature, the pitch of the screw thread being less than 12 mm, the shoulder angle of said screw thread being less than 90°, and the pitch angle of said screw thread being less than 11° but more than 5.6°.

2. Drill element according to claim 1, wherein in that the pitch angle is from 5.6° to 7.6°.

3. Drill element according to claim 2, wherein the pitch angle is about 6.6°.

4. Drill element according to claim 1, wherein the pitch is less than 9 mm.

5. Drill element according to claim 1, wherein the pitch is 7.5 mm.

6. Drill element according to claim 1, wherein the radius of curvature of the crown of the screw thread is less than 4 mm.

7. Drill element according to claim 1, wherein the radius of curvature of the crown of the screw thread is 3.0 mm.

8. Drill element according to claim 1, wherein the shoulder angle has a magnitude of 60°.

9. Drill element according to claim 1, wherein the profile height is less than 1.6 mm.

10. Drill element according to claim 1, wherein the profile height is less than 1.5 mm.

11. Drill element according to claim 1, wherein the profile height is 1.35 mm.

12. Drill element according to claim 1, wherein the ratio between the radius of curvature of the crown of the screw thread and the profile height is less than 3.75 mm.

13. Drill element according to claim 12, wherein said ratio is less than 2.6 mm.

14. Drill element according to claim 12, wherein said ratio is about 2.2 mm.

15. Drill element according to claim 1, wherein the radius of curvature of the root of the screw thread is less than the radius of curvature of the crown of the screw thread, the radius of curvature of the root of the screw thread being 2.5 mm.

16. Drill element according to claim 15, wherein the radius of curvature of the root of the screw thread is 0.5 mm.

* * * * *

UNITED STATES PATENT AND TRADEMARK OFFICE

CERTIFICATE OF CORRECTION

PATENT NO. : 4,760,887

DATED : August 2, 1988

INVENTOR(S) : Kjell-Ove L. Jansson; Lars E. Liljeblad; Bernt S. Liljekvist

It is certified that error appears in the above-identified patent and that said Letters Patent is hereby corrected as shown below:

Column 4, line 18, change "90°" to -- 69° --.

Signed and Sealed this

Twenty-seventh Day of February, 1990

*Attest:*

JEFFREY M. SAMUELS

*Attesting Officer* *Acting Commissioner of Patents and Trademarks*